US007204430B2

(12) United States Patent
Barmakian et al.

(10) Patent No.: US 7,204,430 B2
(45) Date of Patent: Apr. 17, 2007

(54) TIE SUITABLE FOR USE ON A TRACK

(76) Inventors: Andrew Barmakian, 1485 S. Willow Dr., Rialto, CA (US) 92376; Andrew Douglas Barmakian, 1485 S. Willow Dr., Rialto, CA (US) 92376

( * ) Notice: Subject to any disclaimer, the term of this patent is extended or adjusted under 35 U.S.C. 154(b) by 0 days.

(21) Appl. No.: 11/058,467

(22) Filed: Feb. 14, 2005

(65) Prior Publication Data

US 2006/0180046 A1 Aug. 17, 2006

(51) Int. Cl.
*E01B 3/00* (2006.01)

(52) U.S. Cl. ..... 238/29

(58) Field of Classification Search ..... 238/29, 238/83, 84, 85, 50, 51; 104/2
See application file for complete search history.

(56) References Cited

U.S. PATENT DOCUMENTS

| | | | | |
|---|---|---|---|---|
| 3,063,399 | A | 11/1962 | Schuyler | |
| 3,305,991 | A | 2/1967 | Weismann | |
| 3,555,131 | A | 1/1971 | Weismann | |
| 3,912,325 | A | 10/1975 | Sudyk | |
| 4,083,491 | A * | 4/1978 | Hill | 238/98 |
| 4,150,790 | A | 4/1979 | Potter | |
| 4,903,446 | A | 2/1990 | Richards et al. | |
| 5,180,531 | A | 1/1993 | Borzakian | |
| 5,339,594 | A | 8/1994 | Ventura-Berti | |
| 5,501,055 | A | 3/1996 | Storch et al. | |
| 5,766,711 | A | 6/1998 | Barmakian | |
| 5,937,521 | A | 8/1999 | March et al. | |
| 6,021,958 | A * | 2/2000 | Smith | 238/83 |
| 6,191,228 | B1 | 2/2001 | Nosker et al. | |
| 6,244,014 | B1 | 6/2001 | Barmakian | |
| 6,298,622 | B1 | 10/2001 | Cretti | |
| 6,322,863 | B1 | 11/2001 | Kubicky | |
| 6,336,265 | B1 | 1/2002 | Niedermair | |
| 6,412,431 | B1 | 7/2002 | Barmakian | |
| 2004/0074180 | A1 | 4/2004 | Barmakian | |
| 2004/0074202 | A1 | 4/2004 | Barmakian | |

FOREIGN PATENT DOCUMENTS

| | | |
|---|---|---|
| EP | 0894899 | 3/1999 |
| WO | WO 02/22964 | 3/2002 |

OTHER PUBLICATIONS

U.S. Appl. No. 10/927,569, Barmakian.
U.S. Appl. No. 10/997,025, Barmakian.
Schut, Jan H., They've Been Working on the Railroad, Plastics Technology, www.plasticstechnology.com, Jan. 17, 2005.
Nawy, Edward G., Reinforced Concrete, Prentice Hall International, 5th Edition (2003).

* cited by examiner

*Primary Examiner*—S. Joseph Morano
*Assistant Examiner*—Robert J. McCarry, Jr.
(74) *Attorney, Agent, or Firm*—Jeffrey G. Sheldon; Sheldon Mak Rose & Anderson PC

(57) ABSTRACT

A railroad track tie comprises a body formed at least partially of polymeric material, and a reinforcement totally encapsulated within the body, wherein there is at least one opening through the reinforcement with polymeric material therein.

22 Claims, 15 Drawing Sheets

TIE SUITABLE FOR USE ON A TRACK

This application is related to application Ser. No. 10/278,754 filed Oct. 22, 2002; application Ser. No. 10/346,204 filed Jan. 15, 2003; application Ser. No. 10/927,569 filed Aug. 25, 2004; and application Ser. No. 10/997,025, filed Nov. 22, 2004. All of the aforementioned applications are incorporated herein by reference.

BACKGROUND

A tie is a beam like structure that provides support for a track, and in the case of railroad tracks, couples or ties the rails of a train track. As FIG. 1A illustrates, which is taken from the U.S. Pat. No. 6,336,265 to Niedermair, ground based railway cross ties 100 are positioned on and supported by a rail bed 102 that is mostly comprised of crushed gravel that forms a ballast base 104 that supports the entire cross tie 100. In use, the ground based cross ties 100 are positioned in a parallel and spaced apart configuration partially submerged within the ballast 104 so that the upper surface 106 of each cross tie 100 is exposed, and the rest of their body is securely grounded and is supported by the ballast 104. Two railroad track rails 108 are secured in place to the cross ties 100 in a well known conventional manner, such as by spikes 110.

FIG. 1B illustrates a typical wooden cross tie 120 used on a railway bridge. The tie 120 rests on two steel girders 122 rather than being submerged within ballast 104. Conventionally, bridge rails 108 are placed or positioned such that the girder span (or length) $L_G$ between the girders 122 is equal to or greater than the rail span $L_R$ between the two rails 108. In other words, a horizontal distance 123 separates the outer edges 125 of the rails 108 from the inner top surface edges 127 of the girders 122. The wider girder span $L_G$ creates greater stability and therefore supports and protects (prevents) the train from flipping over from centrifugal forces during turns. The horizontal distance 123 between the rails 108 and the girders 122 (or the girder span $L_G$) depends on engineering and construction constraints. For example, a bridge may have electric or other utility pipes that extend along the length of the bridge, and which may be laid in between the girders 122. In such an instance, the girder span $L_G$ (and hence the horizontal separation 123) would have to be sufficiently long to accommodate the placement of the utility pipes. On the other hand, a bridge might not have any utility lines or pipes, which would allow for a shorter horizontal separation distance 123 between rails 108 and girders 122.

As illustrated in FIG. 1C, under heavy load conditions, the ties 120 must withstand horizontal forces, which are generally parallel along the axis of the beam 120. The horizontal forces may include tensile forces such as those indicated by arrow A and arrow B, and/or compression forces indicated by arrow C and arrow D. The tensile and compression forces can cause horizontal shearing 124 that are generally parallel along the axis of the beam 120. As FIG. 1D illustrates, under heavy load conditions, the ties 120 must in addition withstand vertical forces that are normal to the beam 120, such as bending moments, which can cause vertical shearing 126 perpendicular to the beam 120. As illustrated, the shearing 126 is at or near where the actual load is experienced by the beam 120, which is proximal to the outer edges 125 of the rails 108 and the inner top surface edges 127 of the girders 122, where an unsupported distance 123 between the these two edges exists. Of course, the beam 120 need not bend to shear vertically. As stated in Chambers Dictionary of Science and Technology, volume 2, 1974, shearing is a "type of deformation in which parallel planes in a body remain parallel but are relatively displaced in a direction parallel to themselves; in fact, there is a tendency for adjacent planes to slide over each other. For example, a rectangle, if subjected to a shearing force parallel to one side, becomes a parallelogram. The bending moment at any imaginary transverse section of a beam is equal to the algebraic sum of the moments of all the forces to either side of the section of the beam." Therefore, bridge cross ties 120 may differ in construction compared with ground based cross ties in that bridge cross ties must have a higher structural strength and integrity to withstand and oppose all the tensile, compression, shear, and torsion forces and bending moments that are exerted by a heavy load. With ground based cross ties, the ballast 104 bears and opposes some of these forces.

Most conventional ties (bridge or ground) have been formed from hardwood, concrete, or steel. Conventional hardwoods present disadvantages in that given their scarcity, they are expensive to produce and susceptible to decay. This is particularly true in marine environments where hardwood bridge cross ties are used on bridges that span over bodies of water. Hardwood cross ties can be treated with creosote to prolong their life span. However, creosote is toxic, which can result in potential environmental hazards.

Previous attempts have been made to develop a substitute for the conventional wooden ties, such as by manufacturing cross ties from synthetic resins, concrete, or steel. Although synthetic resins may be used as ground based cross ties, where a ballast exists as a major load bearing support, they cannot be used as bridge cross ties where no rail bed exists. Regarding concrete and steel ties, they are heavy and awkward to maneuver, difficult to install (must provide special openings for spikes), and concrete ties shatter upon impact. Both concrete and steel ties are expensive to make and repair. Furthermore, steel, standing either alone or as reinforcement in porous concrete, is subject to corrosion.

Other attempts have been made to provide long lasting ties. Reference is made to U.S. Pat. Nos. 6,336,265 and 4,150,790. Regrettably, these ties suffer from one or more disadvantages such as low bending strength, low resistance to impact loading, short life, difficult installation and/or lack of durability.

SUMMARY

The present invention provides a tie that is suitable for many uses including railroad tracks over bridges, and overcomes disadvantages of prior art ties. In one version of the invention, a tie suitable for use for a railroad track comprises a substantially rectangular prismatic body having dimensions of about the same size as conventional ties, which means it has a length of from about 6 to about 14 feet, a width of about 6 to about 16 inches, and a depth of from about 6 to about 16 inches. The body comprises a polymeric material and has substantially completely embedded therein an elongated reinforcement structure. There is at least one opening through the reinforcement structure with polymeric material therein.

The tie is suitable for use for a vehicle track comprising at least one rail, a plurality of elongated ties supporting the rail, and a plurality of spikes holding the rail to the tie. Typically, there are two parallel rails, such as in the case of a railroad track.

In a preferred version of the invention, the reinforcement structure comprises a top flange and a bottom flange connected by a shear plate, wherein the opening is through the shear plate.

DRAWINGS

These and other features, aspects, and advantages of the present invention will become better understood with reference to the following description, appended claims, and accompanying drawings, in which like reference character (s) present corresponding parts throughout, where:

DESCRIPTION

Most conventional ties are made of very strong hardwood timbers, which are very scarce, expensive to produce, and susceptible to decay. The present invention provides ties that are strong, easily installed, environmentally sound, and more durable, and are particularly adapted for use as bridge ties. Ties according to the present invention in general comprise a reinforcement structure that is completely encapsulated inside a polymeric body. The structures of the present invention are configured to provide sufficient strength to withstand the tensile, compression, shear, and torsion forces and bending moments that are exerted by a heavy load. The structures are also configured for efficient metal usage and weight.

The encapsulation of the reinforcement structure within the polymeric body in accordance with the present invention contributes to the longevity of the ties by protecting the metal from corrosive intrusions. The reinforcement structure provides at least a substantial portion of the structural strength, integrity, and stability. In other words, the reinforcement structure functions to provide the structural core to resist bending and shear loads. The polymeric body casing provides the bulk of the mass needed to which other members can be affixed, non-limiting example of which are rails and spikes, to allow the encapsulated structure to function as tie. The casing also provides a non-conductive mass to prevent an electrical current from passing from one steel rail to another (prevents cross circuiting), if the tie is used in as a railway cross tie. It is an industry standard practice to use the steel rails on a railway to send electrical signal to traffic control systems.

Figure 1A:
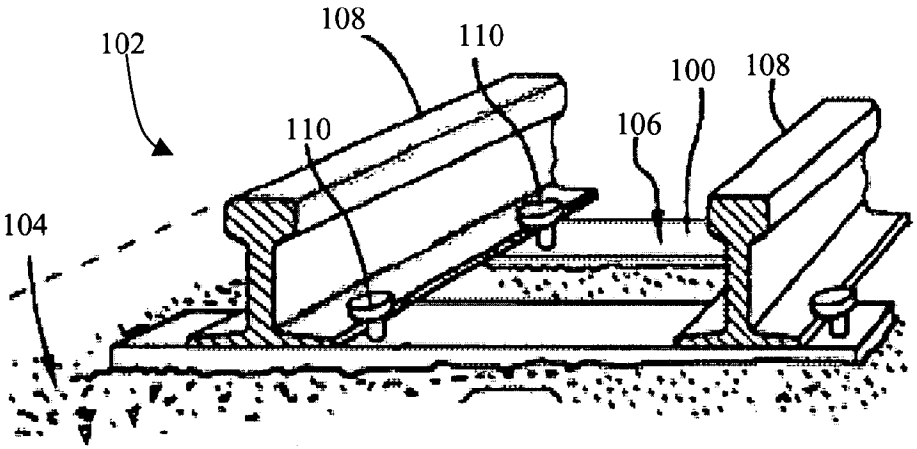
FIG. 1A (PRIOR ART)
FIG. 1A is an exemplary illustration of a prior art railroad track.
Figure 1B:
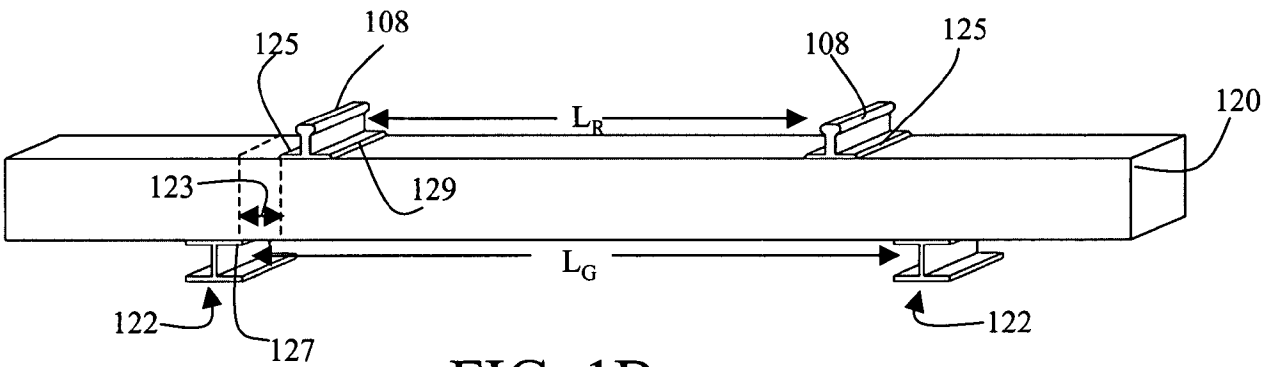
FIG. 1B (PRIOR ART)
FIG. 1B is an exemplary illustration of a prior art bridge cross tie.
Figure 1C:
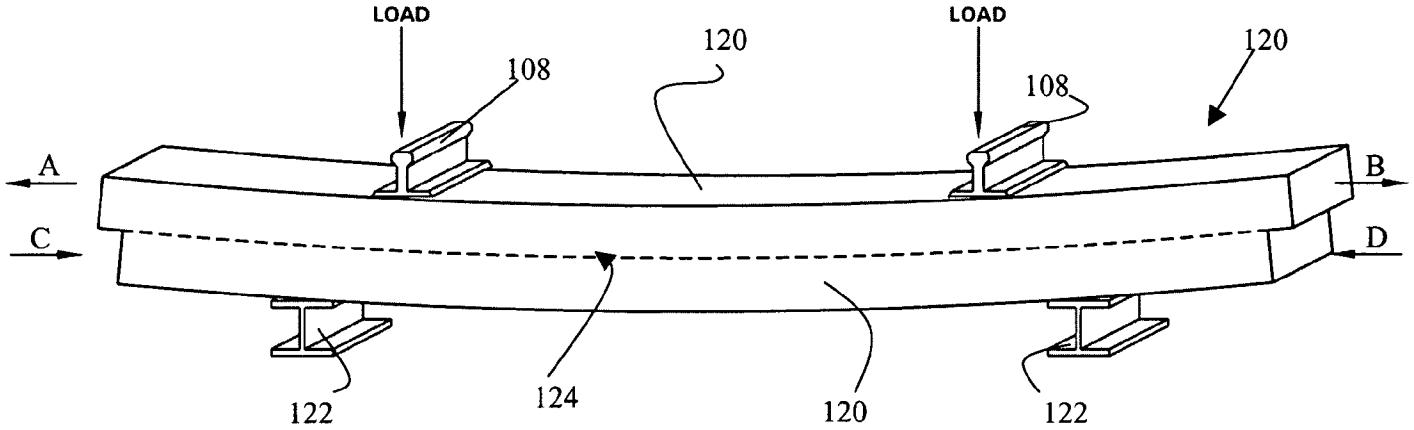
FIG. 1C (PRIOR ART)
FIG. 1C is an exemplary illustration of a prior art bridge cross tie under heavy load conditions with applied horizontal forces, causing horizontal shearing.
Figure 1D:
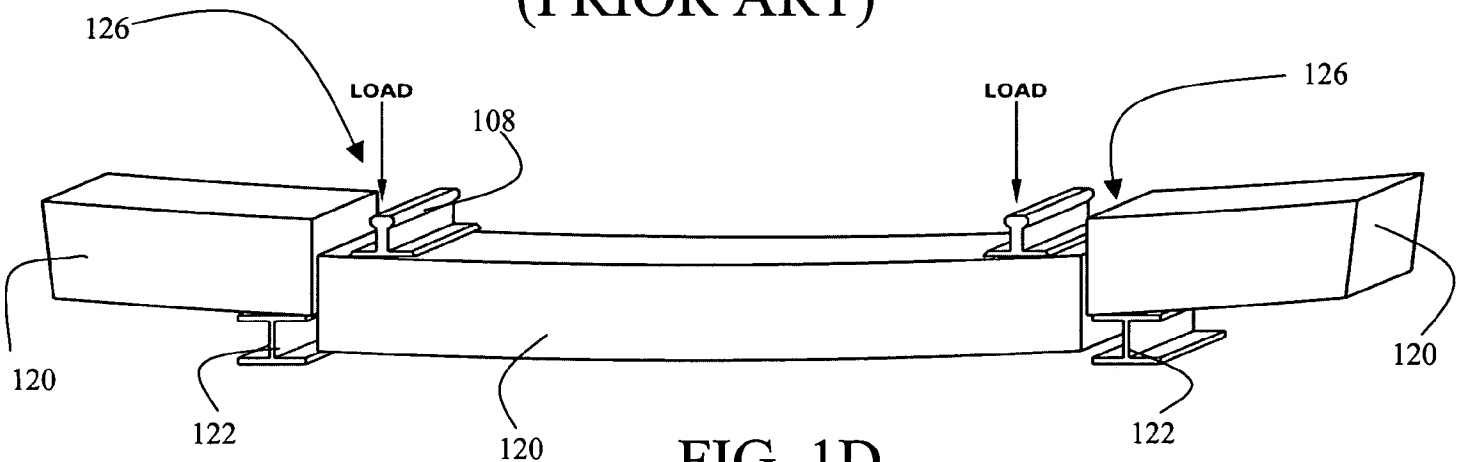
FIG. 1D (PRIOR ART)
FIG. 1D is an exemplary illustration of a prior art bridge cross tie under heavy load conditions with applied vertical forces, causing vertical shearing.
Figure 2:
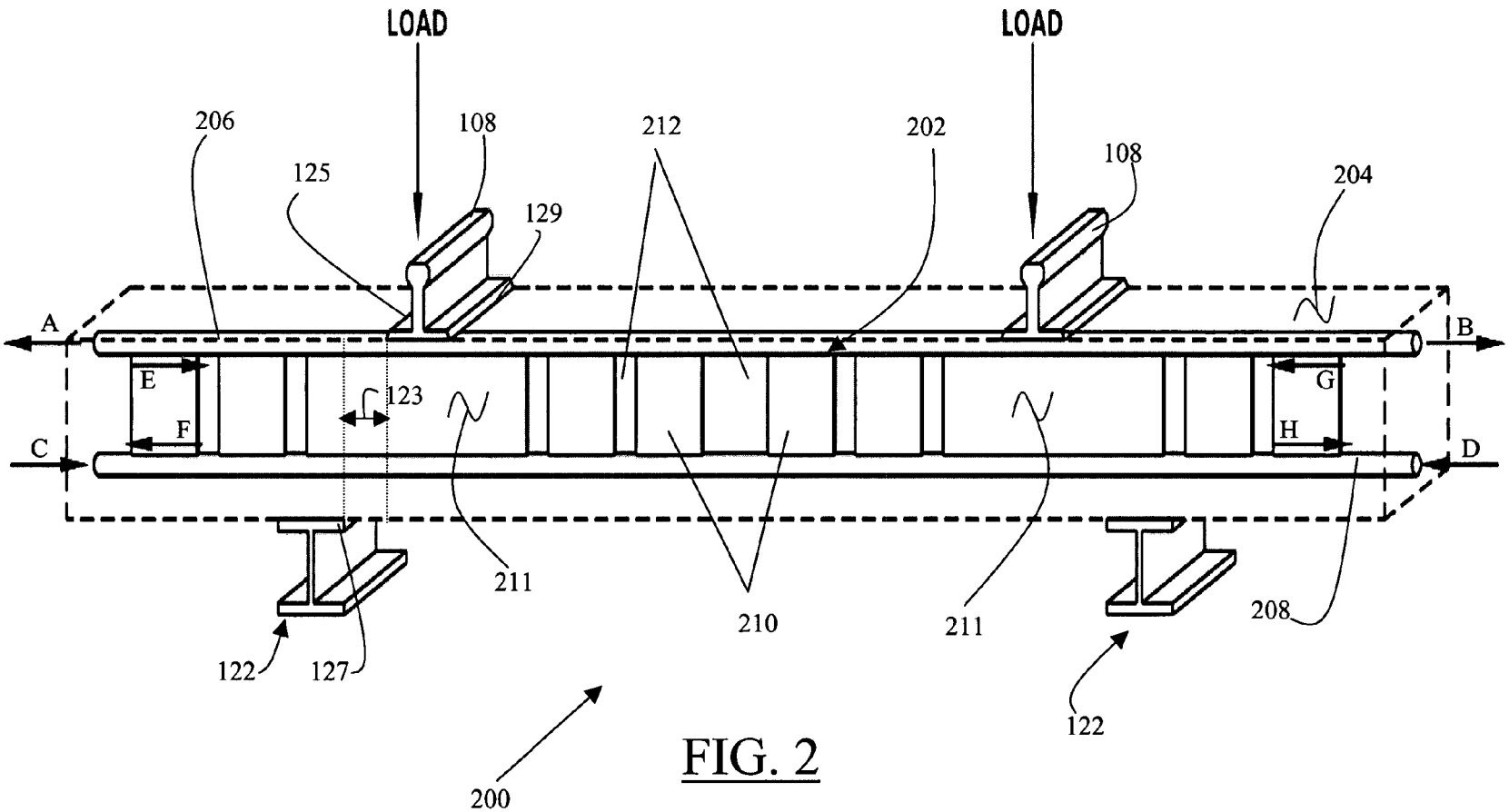
FIG. 2 illustrates a railroad cross tie comprising a reinforcement encapsulated inside a body, in accordance with the present invention.

FIG. 2 is an exemplary cross-sectional illustration, taken along the longitudinal axis of a tie 200 according to the present invention, which is comprised of a metallic (preferably weldable steel or steel alloy) reinforcement structure 202 encapsulated, and preferably centrally located in all dimensions, inside a body 204. Preferably, the body 204 comprises a polymeric material, i.e., a substance made of many repeating chemical units or molecules. As illustrated, the tie 200 rests on two steel girders 122 in a conventional manner, where the rails 108 are positioned such that the girder span (or length) $L_G$ between the girders 122 is in general equal to or greater than the rail span $L_R$ between the two rails 108. In other words, the outer edges 125 of the rails 108 are in general near the inner top surface edges 127 of the girders 122, with a separation distance 123 between the two edges as illustrated. Under heavy load conditions, the tie 200 can withstand tensile, compression, shear, and torsion forces and bending moments because of reinforcement structure 202, which comprises an axial or longitudinal upper flange 206 and lower flange 208, and coupled shear plates 210 and 211 (also known as web plates).

The use of shear plates 210 and 211 in combination with the flanges 206 and 208 provides great strength to the tie 200. The use of web or shear plates 210 and 211 allow for the connection of the flanges together, which in turn form a rigid structural core to resist bending moments, shear and other forces. That is, flanges 206 and 208 aid in supporting the load, and the shear plates 210 and 211 help prevent the flanges 206 and 208 from bending vertically normal to the top surface of the beam 200 or moving horizontally relative to the beam 200 due tensile, compression, shear, and torsion forces and bending moments that are applied to the beam 200 when under heavy load. The flanges 206 and 208 without their connection to each other by the web or shear plates 210 and 211 do not provide as much strength.

In general, to prevent horizontal shearing, the shear plates 210 and 211 provide opposing tensile forces indicated by the arrows E and G against the load tensile forces indicated by the arrows A and B. Furthermore, the same shear plates 210 and 211 also facilitate in providing opposing compression forces indicated by the arrows F and H against the load compression forces C and D.

In particular, to prevent vertical shearing, the shear plates 211 span across the entire underneath width of each rail 108, including their inner edges 129 and outer edges 125, with a shear plate 211 length that also spans over and includes at least the inner edges 127 of the top surfaces of the girders 122. However, it is preferable that the length of the shear plates 211 extend to include at least one half of the top surface of the girders 122, and most preferable if the length of the shear plate 211 covers all of the top surface of the girders 122. This type of juxtaposing of the shear plates 211 in relation to the rails 108 and the girders 122 provides support, and opposes vertical shearing forces against load vertical shearing that generally occur near inner edges 127 of girders 122.

The use of spaced apart web or shear plates 210 and 211 in combination with the flanges 206 and 208 also facilitates efficient material usage and lower structural weight for the tie 200. The spacing 212 between all the web or shear plates 210 and 211 can vary depending on the size of the flanges 206 and 208 being used for a particular application.

Injection molding techniques preferably are used to encapsulate the structure 202 inside the body 204. The spacing 212 between all the shear plates 210 and 211 allow injected material inside the mold to converge from both sides of the structure 202 to interlock, bind and firmly grasp the structure 202, providing greater structural integrity for the body 204. The body 204 encapsulating the frame 202 protects it from the outside environment, provides the required bulk (without any negligible addition of weight) to enable the frame 202 to rest on the girders 122, and absorbs (dampens) vertical vibration between the rails 108 and the girders 122 due to passing heavy loads. In addition, the use of spaced plates 210 and 211, and the body 204 lowers the overall weight of the beam 200, facilitating its easier handling. Furthermore, the reinforced ties 202 inside the body 204 are in general installed in the same manner as wood ties by using spikes 110, but have the added benefit that they do not split, which may be the case for some wood tie.

The present invention provides various embodiments in terms of reinforcement 202 for a tie, the differences of which are mostly related to the number, size, and shape of the shear or web plates, the flanges, and the configuration or arrangement of the shear or web plates in relations to each other and the flanges. The paragraphs that follow describe in detail the various embodiments in terms of different reinforcements used for a tie in accordance with the present invention, including the use of an I-beam like frame, and frames with different cross-sectional geometry, the nonlimiting examples of which may include three or more sided frames (e.g., triangles, quadrilaterals such as squares, rectangles, trapezoid, or circular, cylindrical, prismatic, etc).

A typical railroad tie according to the present invention has a length of about six feet to about fourteen feet, a width from about six to about sixteen inches, and a depth from about six to about sixteen inches. It generally is in the shape of a rectangular or square prism, i.e., a vertical cross-section through the railroad tie 200 yields a rectangular or square.

Figure 3A:
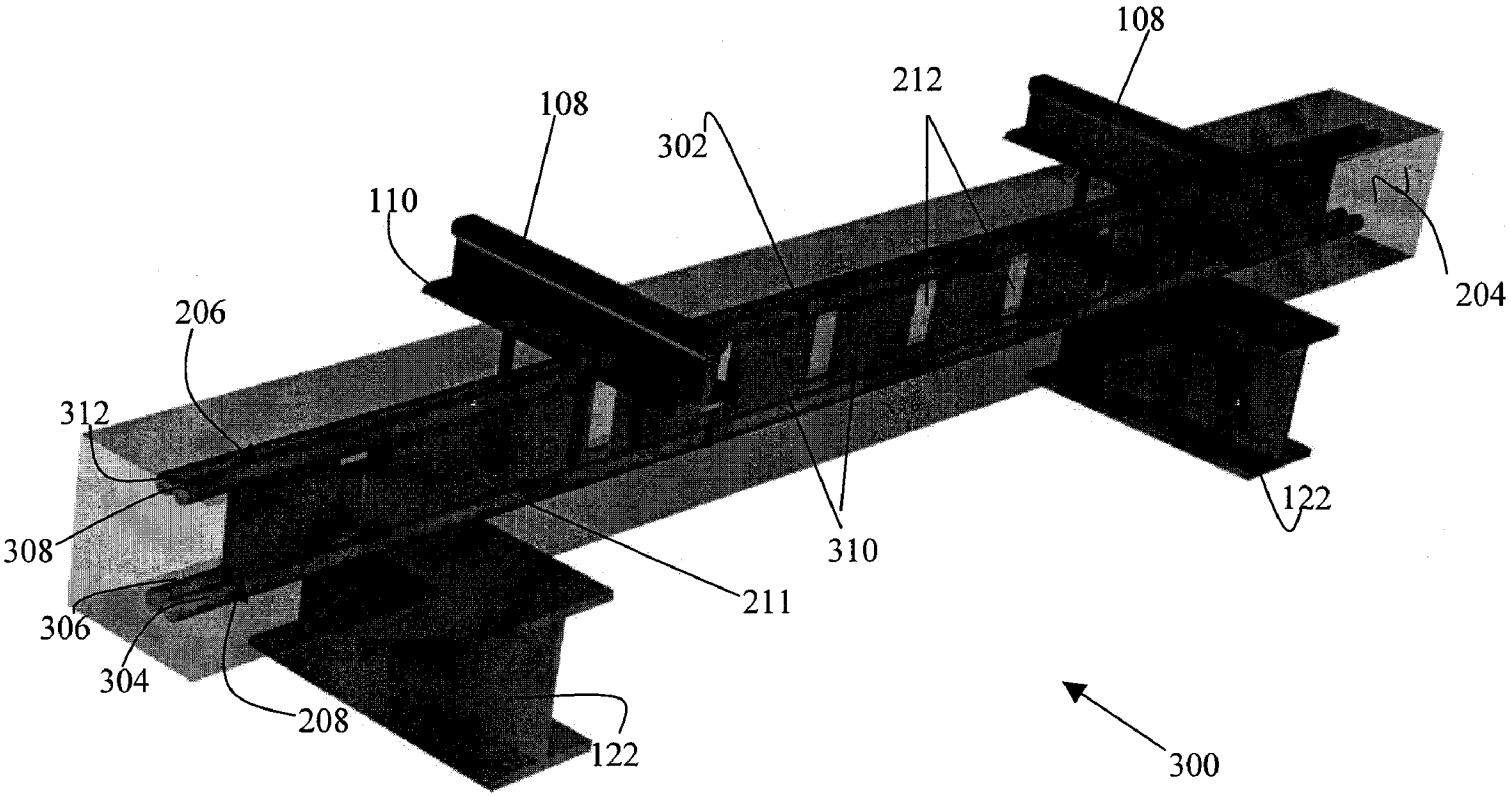
FIGS. 3A and 3B are perspective illustrations of an I-beam type reinforcement encapsulated inside a body, in accordance with the present invention.
Figure 3B:
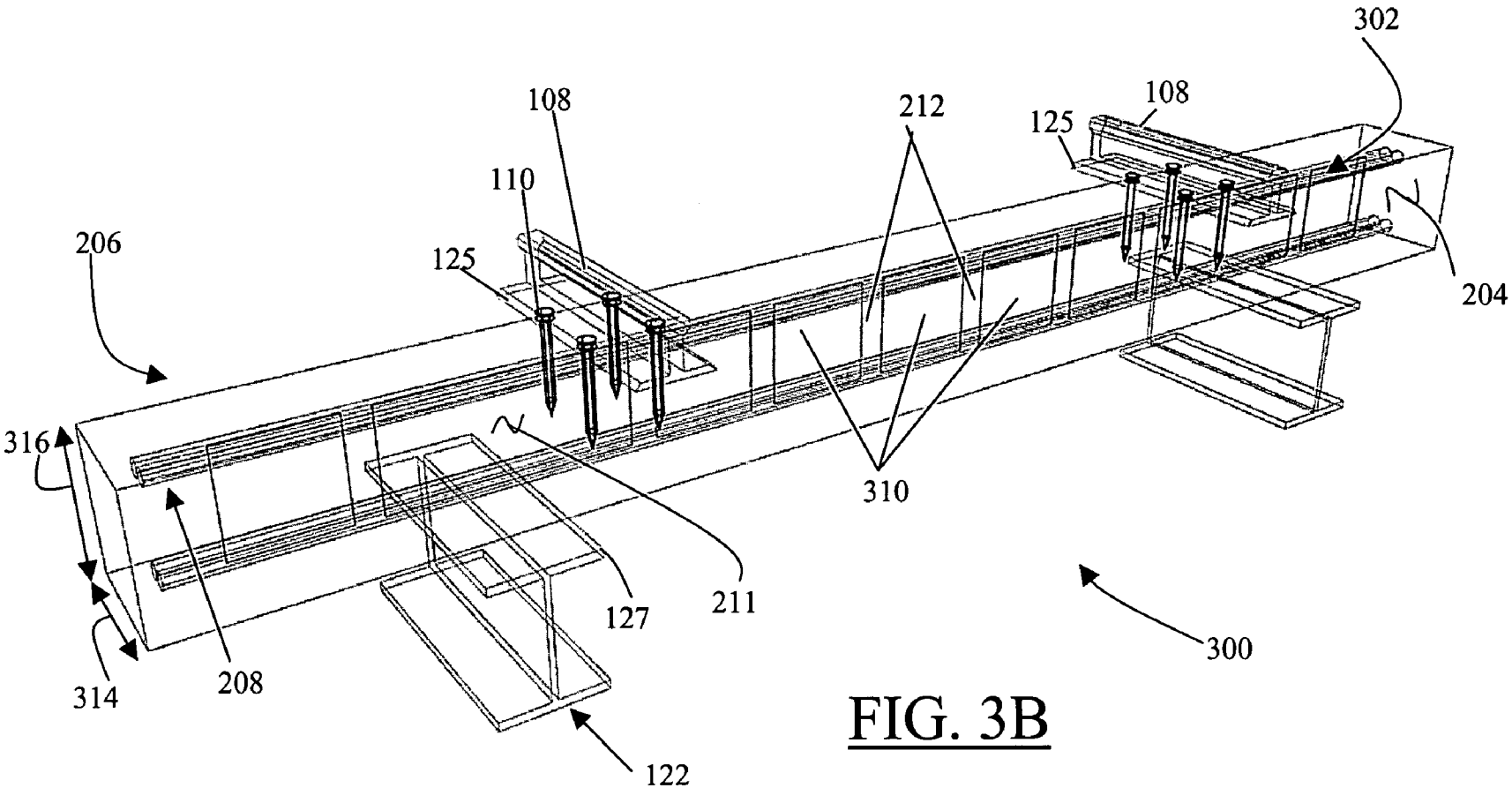

FIGS. 3A to 3H are exemplary illustration of I-beam like frames with different flanges and shear plate constructions that vary in number, size, and shapes. A commonality between all however, is the fact that the shear or web plates for all the I-beam frame ties are aligned parallel along a single vertical plane passing through the midpoint of the tie width 314 (illustrated in FIG. 3B). As FIGS. 3A and 3B illustrate, the tie 300 is comprised of a structure 302 encapsulated in body 204. The I-beam structure 302 includes an upper flange 206, which is comprised of two axial or longitudinal bars 308 and 312 and a lower flange 208, which is comprised of two axial or longitudinal bars 304 and 306. Coupling the upper flange 206 to the lower flange 208 are web or shear plates 310 and 211, which are sandwiched between the pairs of bars 308 and 312 at an upper proximal end of the plates 310 and 211, and pairs of bars 304 and 306 at a lower proximal ends of the plates 310 and 211. Plates 310 and 211 are welded to the flanges 206 and 208 in locations that can provide the optimum strength, weight, and bulk for the structure 302, with appropriate spacing 212 created between all the plates 310 and 211 for optimal curing of later injected material (using injection molding techniques, described below).

A completely fabricated structure 302 may be placed inside a mold to be encapsulated within body 204 using injection-molding techniques. The interior chamber of the mold may be configured to be commensurate with the required parameters of a typical tie. The structure 302 is intentionally placed in the mold cavity to allow extruded material to evenly be distributed on all sides of the structure 302, and through the spacing 212 for interlocking or grasp between the structure 302 and the extruded material, after the material is cured. As illustrated in FIG. 3B, the structure 302 is placed in the mold (not shown) so that when the material encapsulates it, the structure 302 is fixed in the midpoint of the encapsulating body 204 width 314. This allows the insertion of spikes 110 through the beam 300, close to the body of the structure 302 for a more secure connection a track 108, and further provides a balanced beam 300 in that the beam 300 is not tilted. The height 316, width 314, and length of the beam 300 may be varied.

Injection molding uses equipment similar to that for die casting, in that a precision mold of desired shape is clamped shut, and melted material (for example, from palletized plastics) is forced into the cavity between the mold and the structure 302 that is placed inside the mold. The exemplary palletized plastic material is fed into a heated chamber, or barrel, by a large, slowly rotating mechanism, and is melted. When a sufficient quantity to fill the mold cavity has been prepared, the rotating mechanism is moved axially under high pressure to extrude the melted material into the mold cavity. Some molds may have channels through which coolant is circulated to remove heat and to chill the plastics. When the plastic has cooled sufficiently, the mold is unclamped (or opened), and the molding is either forced out by strategically located ejectors or simply forcefully removed (depending on the type of mold being used.) During cooling and removal, material for the next part is plasticized within the barrel, ready for the cycle to be repeated. For further details of this process and suitable materials for the polymeric body, see U.S. Pat. Nos. 6,244,014 and 6,412,431, all to Barmakian, the entire disclosures of which are incorporated herein by reference. A preferred plastic material for body 204 is recycled polyethylene that contains at least 96% to 98% polyethylene film for lubricity and flexibility.

Figure 3C:
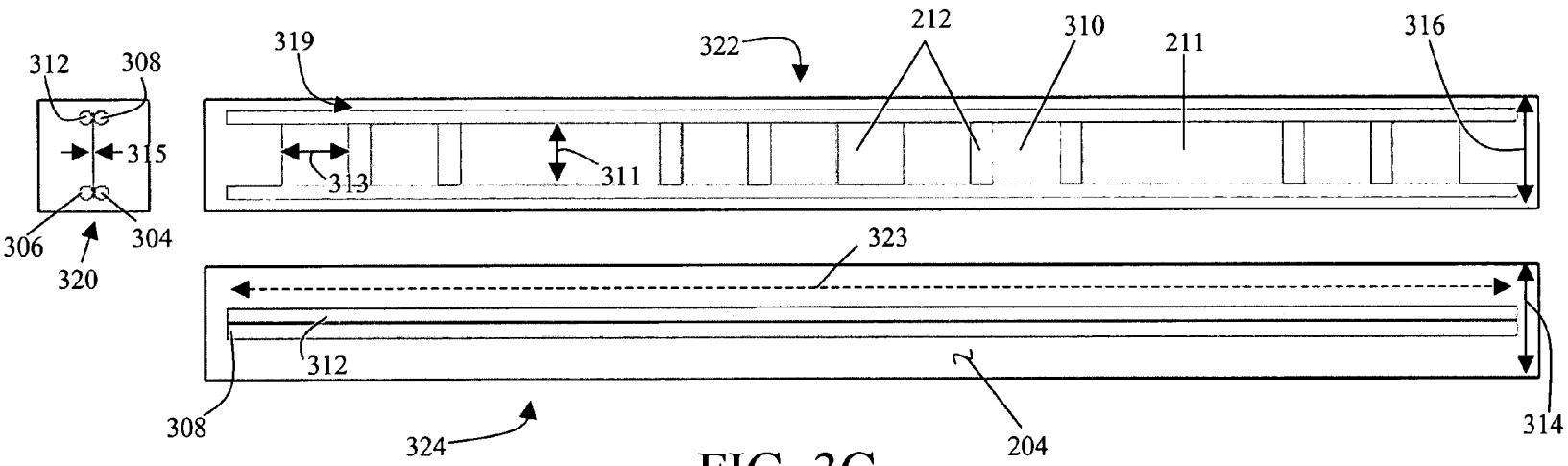
FIGS. 3C to 3H are cross-sectional and top or plan view illustrations of different embodiments of I-beam like reinforcement, in accordance with the present invention.

FIG. 3C is an exemplary illustration of the beam 300 in the cross-sectional views normal to the axial length indicated by the reference 320, along the axial length 322, and the plan or top view 324 taken along the axial length. The nonlimiting exemplary dimensions of the body 204 may include width 314 of about ten inches, a height 316 of about ten inches, and a length of about ten feet. As to the nonlimiting exemplary dimensions of the reinforcement 302, the bars may have an approximate length 323 of about nine feet and eight inches, with a diameter of approximately one-inch. The top and bottom bars may be approximately positioned one inch from the respective top and the bottom surfaces of the body 204. The shear plates 310 may have a nonlimting, exemplary, approximate average thickness 315 of about one-fourth (quarter) inch, with height 311 of about seven and one half inches, and width 313 of about eight inches. The length dimension 313 of the shear plates 211 must be such that the plates span across the entire underneath width of a rail 108, including the inner edge 129 and outer edge 125, with a shear plate 211 length 313 that also spans over and includes at least the inner edge 127 of the top surface of the girder 122. Therefore, the length 313 of the shear plates 211 depends on the separation distance 123 between the outer edge 125 of the rails 108 and the inner top surface edge 127 of the girders 122. As mentioned above, this separation 123 is based on engineering and construction constraints, which may vary between zero inches to three feet. Accordingly, the length 313 of the shear plate 211 must be extended commensurately to accommodate for the separation distance 123. Nevertheless, a nonlimiting, exemplary length 313 of the shear plate 211 may start from about four to six inches, and span across the distance 123. The height 311 and the thickness 315 of the shear plates 211 may be the same as other shear plates. In general, the spacing 212 between all the shear plates 310 and 211 may be about 2 inches. A nonlimiting example of material used for the structure 302 may include weldable steel.

Figure 3D:
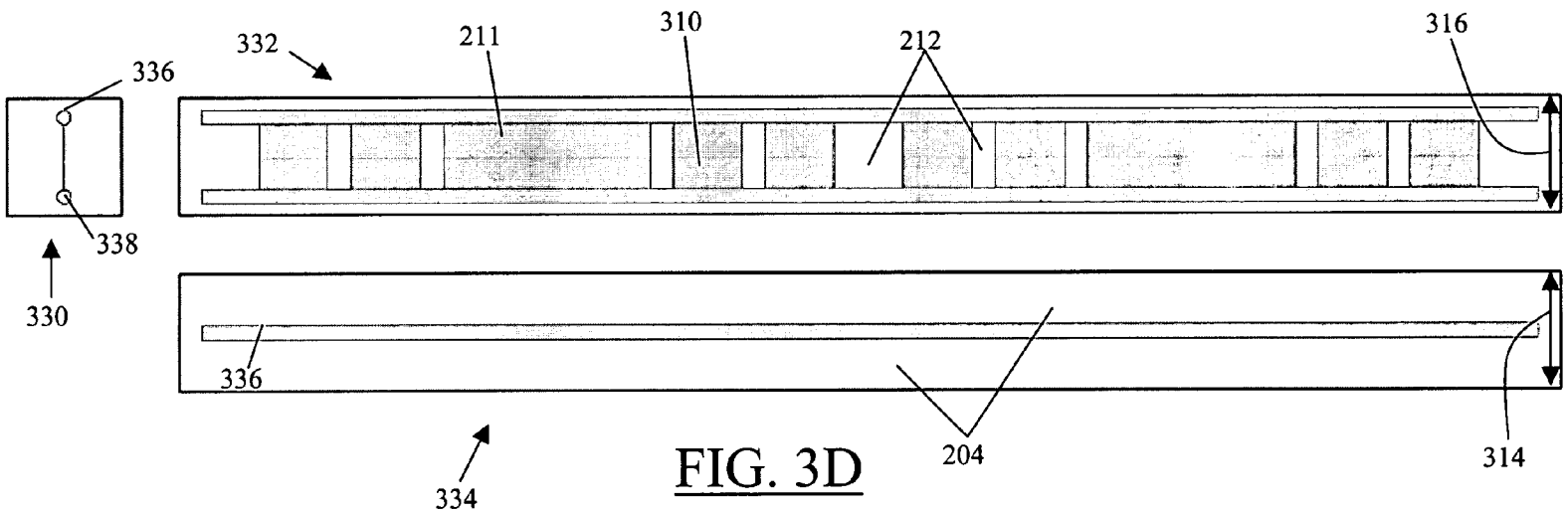

FIG. 3D is an exemplary illustration of another embodiment of the I-beam 300 illustrated in FIGS. 3A and 3B in the cross-sectional views normal to the axial length 330, along the axial length 332, and the plan or top view 334 taken along the axial length of the beam. In this embodiment however, the I-beam structure 302 includes an upper flange 206, which is comprised of one axial or longitudinal bar 336 and a lower flange 208, which is comprised of one axial or longitudinal bar 338. Coupling the upper axial bar 336 to the lower axial bar 338 is a set of web or shear plates 310 and 211. Plates 310 and 211 are welded to the axial bars 336 and 338 in locations that can provide the optimum strength, weight, and bulk for the structure 302, with appropriate spacing 212 created between all the plates 310 and 211 for optimal curing of later injected material.

Figure 3E:
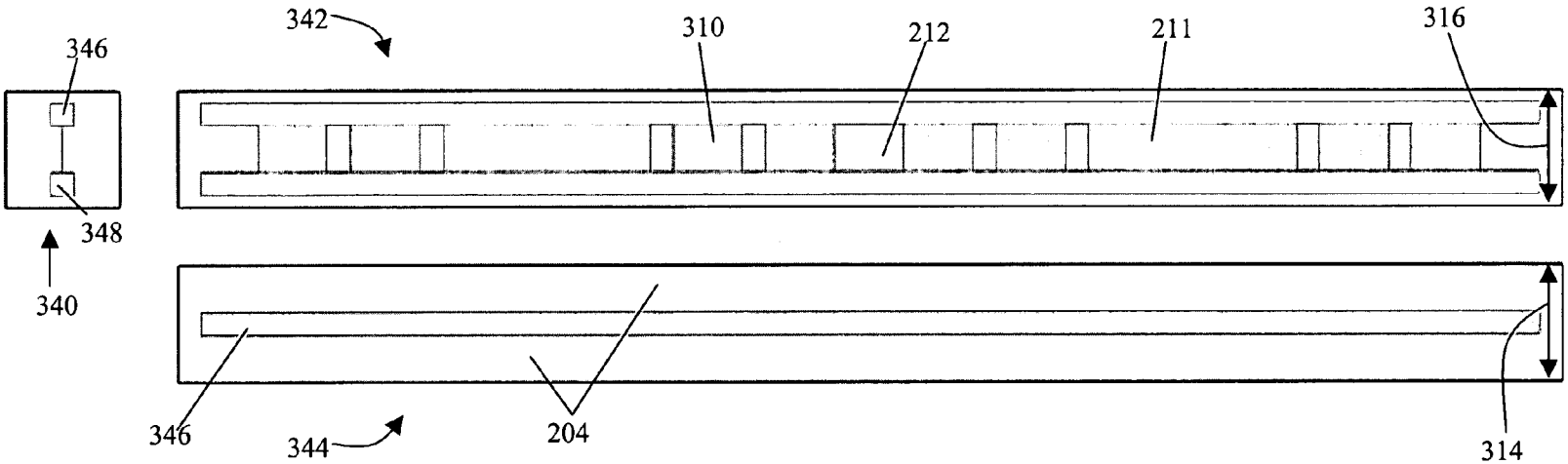

FIG. 3E is an exemplary illustration of another embodiment of the I-beam 300 illustrated in FIGS. 3A and 3B in the cross-sectional views normal to the axial length 340, along the axial length 342, and the plan or top view 344 taken along the axial length of the beam. In this embodiment however, the I-beam structure 302 includes respective upper and lower axial or longitudinal bars 346 and 348 with cross sectional configurations that are substantially quadrilateral.

Figure 3F:
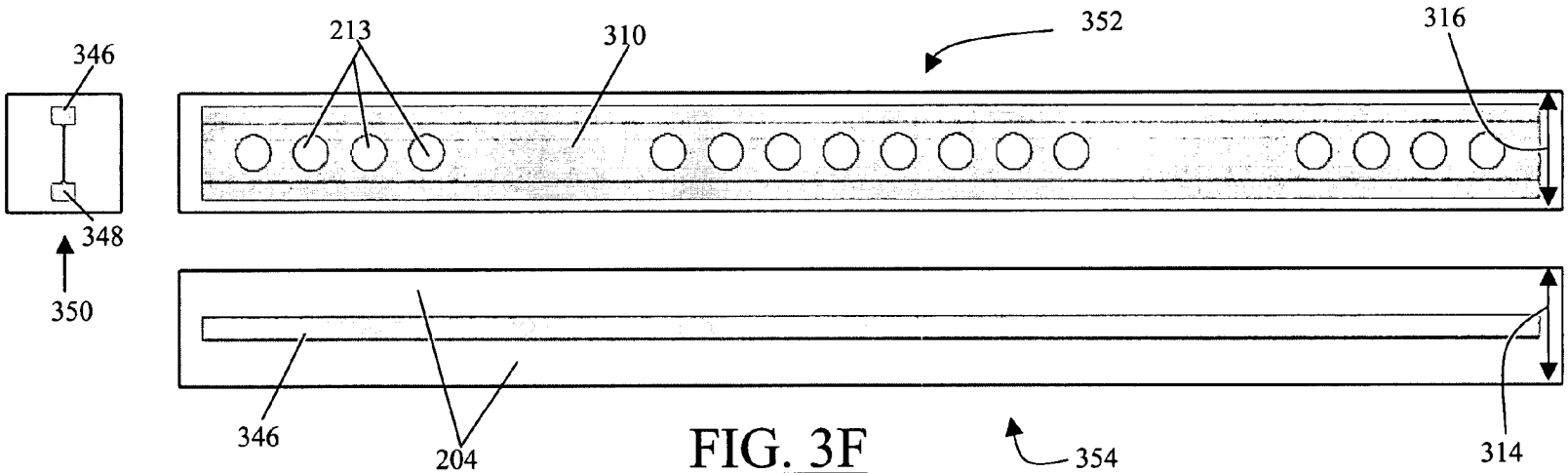

FIG. 3F is an exemplary illustration of yet another embodiment of the I-beam 300 illustrated in FIGS. 3A and 3B in the cross-sectional views normal to the axial length 350, along the axial length 352, and the plan or top view 354 taken along the axial length of the beam. In this embodiment however, the I-beam structure 302 includes web or shear plates 310 that is continuous along the longitudinal axis of the beam, with opening 213.

Figure 3G:
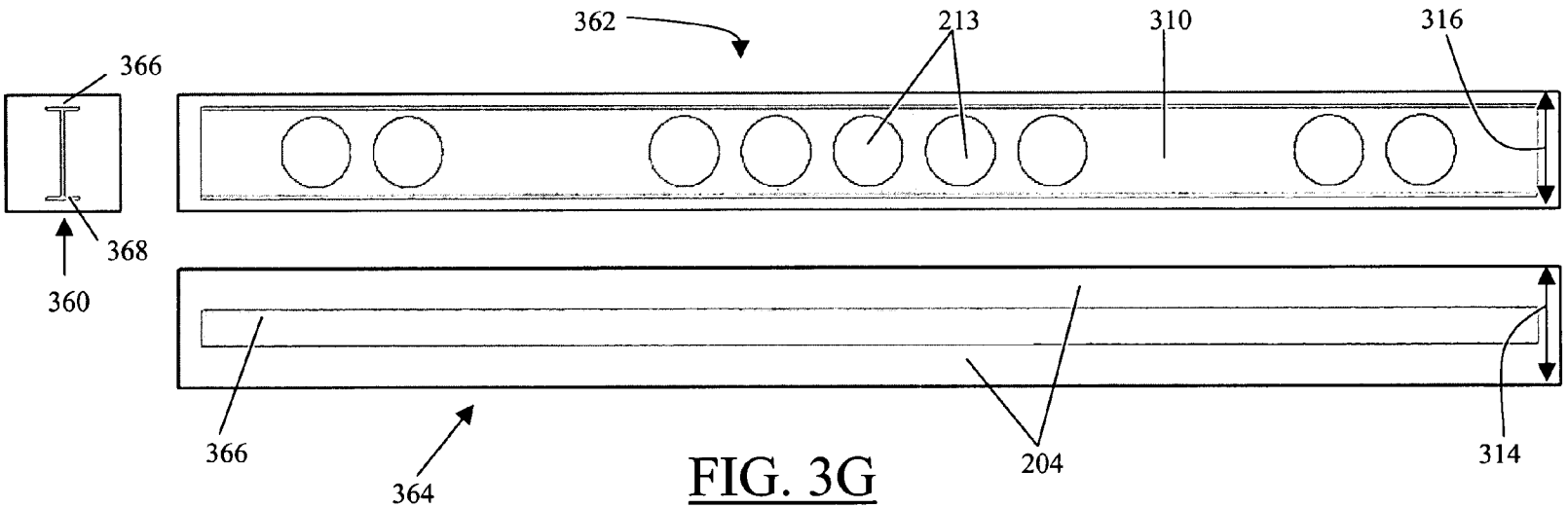

FIG. 3G is an exemplary illustration of still another embodiment of the I-beam 300 illustrated in FIGS. 3A and 3B in the cross-sectional views normal to the axial length 360, along the axial length 362, and the plan or top view 364 taken along the axial length of the beam. In this embodiment however, the I-beam structure 302 includes respective upper and lower axial or longitudinal flanges 366 and 368, that are substantially flat. In addition, the structure 302 includes web or shear plate 310 that is continuous along the longitudinal axis of the beam, and has openings 213.

Figure 3H:
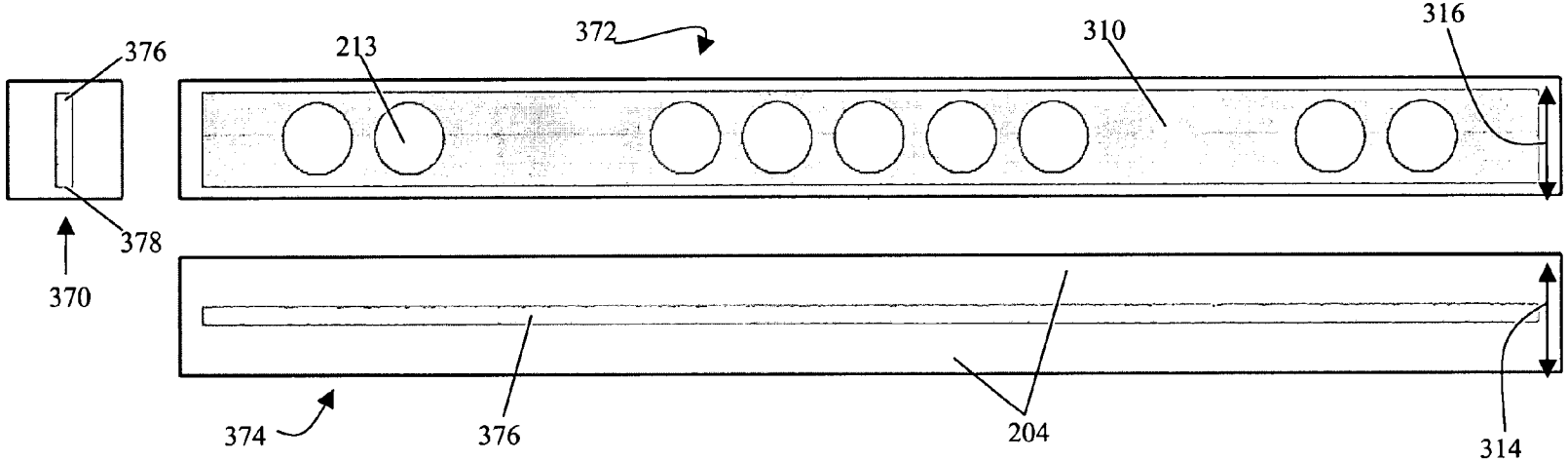

FIG. 3H is an exemplary illustration of yet another embodiment of the I-beam 300 illustrated in FIGS. 3A and 3B in the cross-sectional views normal to the axial length 370, along the axial length 372, and the plan or top view 374 taken along the axial length of the beam. In this embodiment however, the I-beam structure 302 has no flanges or bars, and functions as a web or shear plate 310 with openings 213.

Figure 4A:
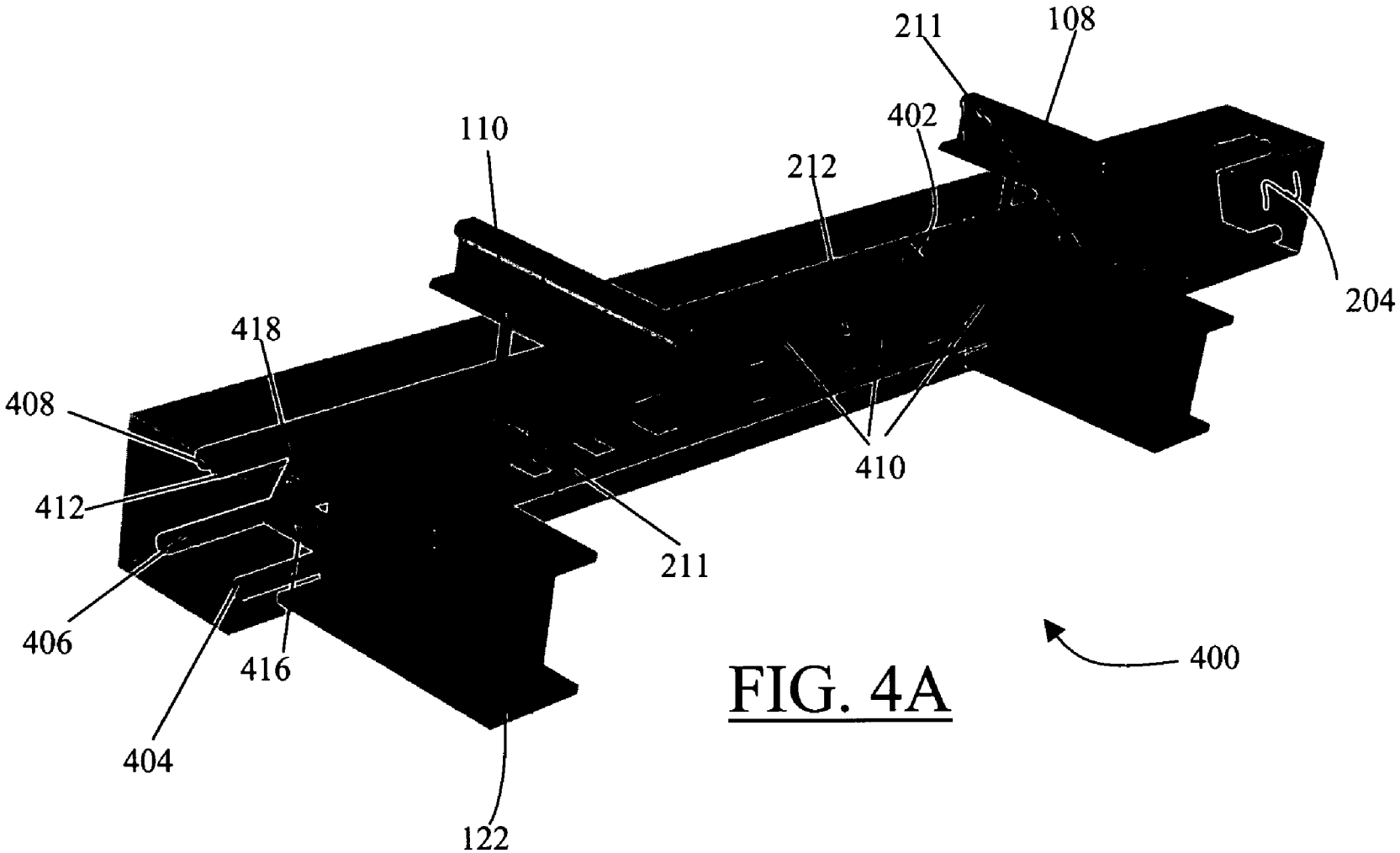
FIGS. 4A to 4C are illustrations of a three sided reinforcement encapsulated inside a body, with FIGS. 4A and 4B illustrating the perspective view, and FIG. 4C illustrating the cross-sectional and plan or top views, all in accordance with the present invention.
Figure 4B:
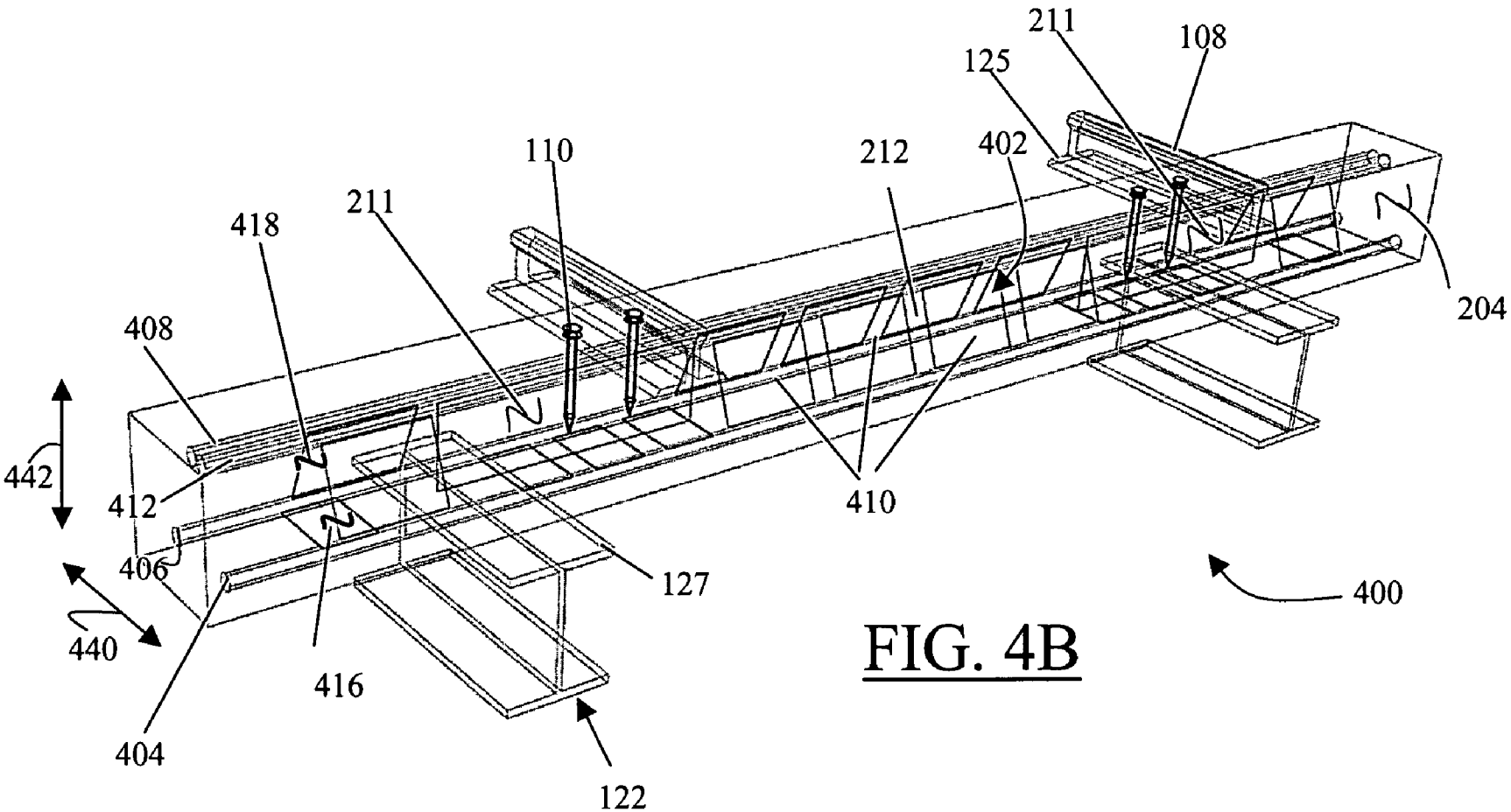
Figure 4C:
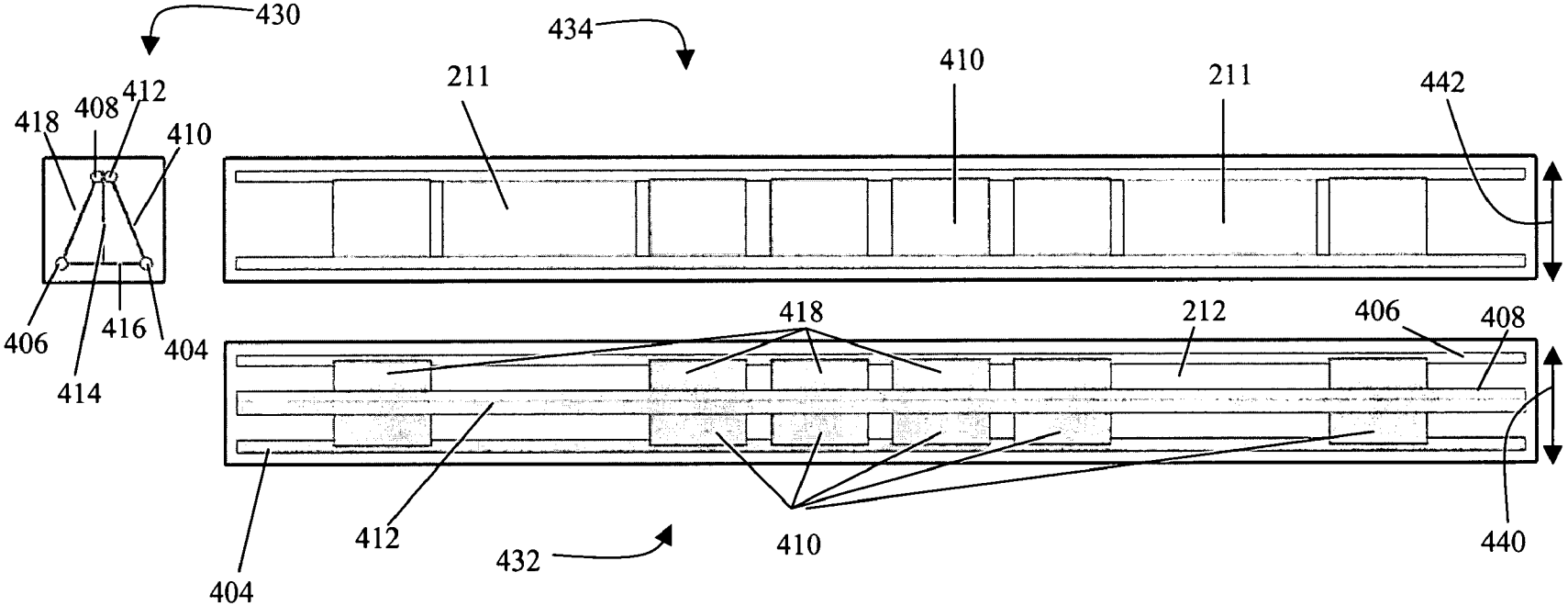

FIGS. 4A to 4C are exemplary illustration of a three sided frame structure, in accordance with the present invention. Although not illustrated for brevity, it should be understood that like the previously illustrated I-beam frames 302 in all the FIGS. 3A to 3H, the three sided frame structure 402 may also be comprised of different flanges and web or shear plate constructions that vary in number, size, and shapes, similar to those illustrated in FIGS. 3A to 3H. In fact, each of the three sides of the triangular structure 402 may be constructed by using any combinations and or permutations of the above-described structure 302. The three sided structure 402 has the added advantage in that it provides further stability for the beam 400 by dividing the applied load stresses along its lower wider base. However, the exterior body 204 dimensions remain the same, commensurate with industry standard practices where the beams are to be used.

As FIGS. 4A and 4B illustrate, the tie 400 is comprised of a structure 402 that has a triangular cross section, encapsulated in body 204. The three corners of the triangular beam structure 402 include a pair of axial or longitudinal bars 408 and 412 that form the first corner, and two axial or longitudinal bars 404 and 406 that form the respective second and third corners of the triangle. The three sides of the triangular beam structure 402 include two sets of laterally inclined web or shear plates 410 and 418 that form the respective first and the second sides, and a bottom web or shear plates 416, which are connected parallel to the ground, forming the third side of the triangular frame 402.

The first corner pair of bars 408 and 412 are coupled to the second corner bar 404 by the first set of laterally inclined web or shear plates 410, and are further coupled to the third corner bar 406 by a second set of laterally inclined web or shear plates 418. The respective first and second set of laterally inclined web or shear plates 410 and 418 have opposing slopes, and each plate within its respective set is coupled so to allow a space 212 between the plates. The respective second and third corners 404 and 406 are coupled by the bottom web or shear plates 416, which are parallel to the ground, and are also coupled so to allow a space 212 between the plates 416.

The triangular beam structure 402 further includes at least two vertically oriented web or shear plates 211. The vertical web or shear plates 211 are generally positioned such that they fall underneath the rails 108 during track assembly, and are aligned along a vertical plane passing through the midpoint of the cross tie width 440 (illustrated in FIG. 4B). The use of vertical web or shear plates 211 rather than the laterally inclined plates 410 or 418 underneath the tracks 108 allow spikes 110 to be passed through the beam 400, close to the upper bars 408 and 412 for a secure connection. The use of inclined web plates 410 or 412 underneath the rails 108 would block the spikes 110. In addition, the web or shear plates 211 provide augmented resistance to vertical compressive loading of the cushion beam in regions between the bars 404 and 406. The upper edges of the vertical plates 211 are coupled to the axial pair 408 and 412, and the lower edges are coupled to the bottom parallel plates 416. As best illustrated in FIG. 4B, the web or shear plates 211 are extended longitudinally, spanning a number of web or shear plates 416. Although not illustrated, plates 211 need not be a single solid unit, but can be comprised of openings similar to those illustrated in FIGS. 3F to 3H.

All the plates are welded to their respective bars (or the bottom parallel plates in the case of the plates 211) at locations that can provide the optimum strength, weight, and bulk for the structure 402, with appropriate spacing 212 created between the plates for optimal curing of later injected material. A completely fabricated structure 402 may be placed inside a mold to be encapsulated within a material using injection-molding techniques to form body 204, as described above in relation to FIGS. 3A to 3H. FIG. 4C is an exemplary illustration of the beam 400 in the cross-sectional views normal to the axial length indicated by the reference 430, along the axial length 432, and the plan or top view 434 taken along the axial length of the beam 400.

FIGS. 5A to 5D are exemplary illustration of a four sided frame structure 502, in accordance with the present invention. Although not illustrated for brevity, it should be understood that like the previously illustrated I-beam frames 302 in all the FIGS. 3A to 3H, the four sided frame structure 502 may also be comprised of different flanges and web or shear plate constructions that vary in number, size, and shapes, similar to those illustrated in FIGS. 3A to 3H. In fact, each of the four sides of the quadrilateral structure 502 may be constructed by using any combinations and or permutations of the above-described structure 302. The four sided structure 502 has the added advantage in that it provides further strength and stability for the beam 500 by dividing the applied load stresses along its four bars, and like its three sided counterpart, it is also stable. However, the exterior body 204 dimensions remain the same, commensurate with industry standard practices where the beams are to be used.

Figure 5A:
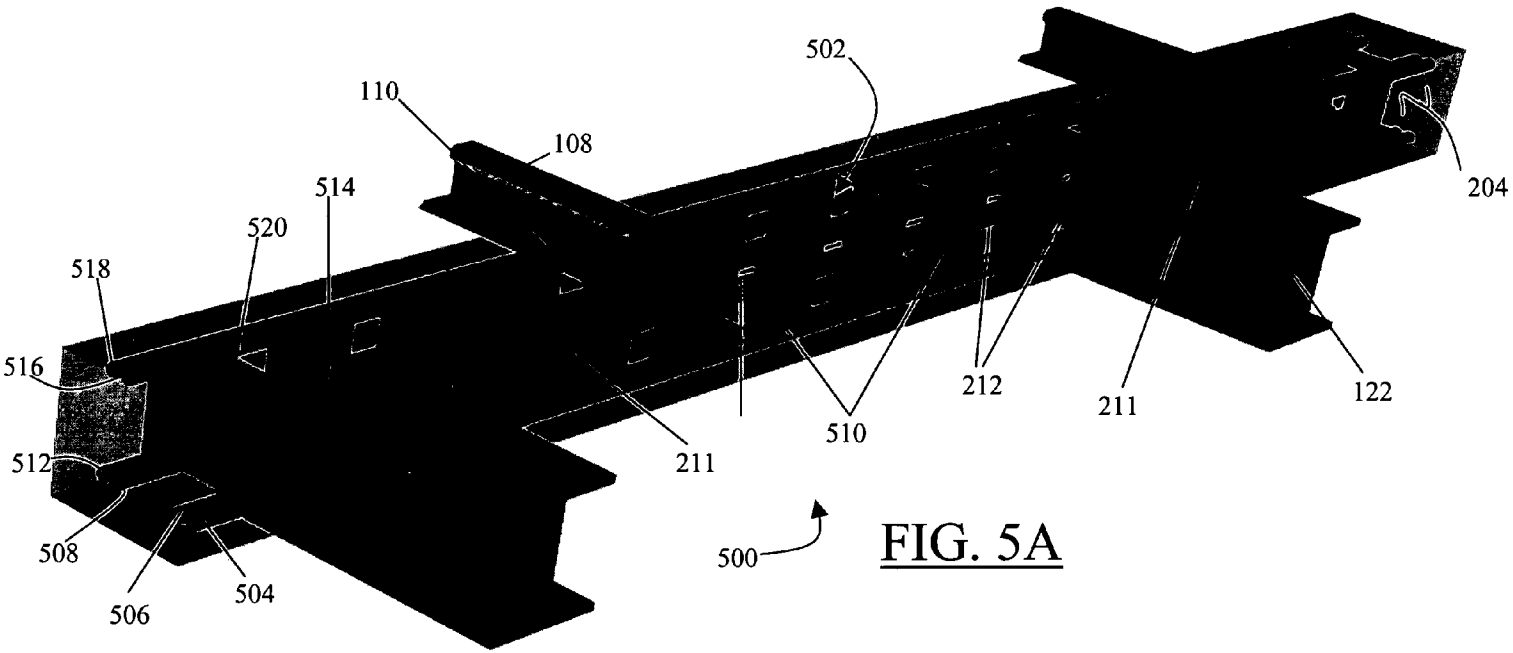
FIGS. 5A to 5D are illustrations of a four sided reinforcement encapsulated inside a body, with FIGS. 5A and 5C illustrating the perspective view, FIG. 5B illustrating the cross-sectional view normal to the reinforcement, and FIG. 5D illustrating the cross-sectional view along the axis of the reinforcement and the top or plan view, all in accordance with the present invention.
Figure 5B:
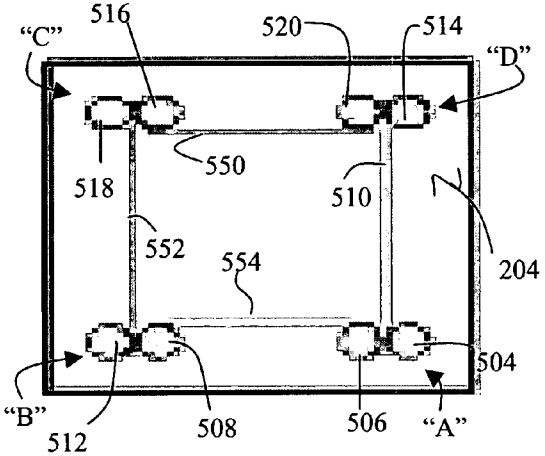
Figure 5C:
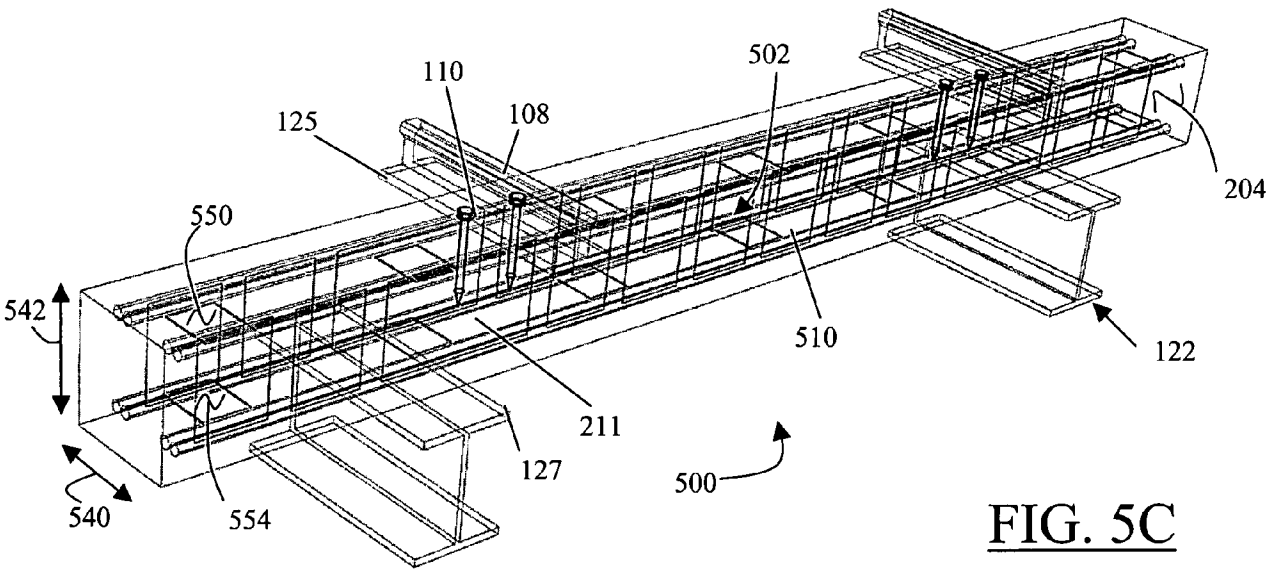

As FIGS. 5A to 5C illustrate, the tie 500 is comprised of a structure 502 that has a quadrilateral cross section, encapsulated in body 204. The quadrilateral structure 502 includes two upper and two lower flanges, each of which may be comprised of one or more axial or longitudinal bars. As best illustrated in FIG. 5B, the four corners A, B, C, and D of the quadrilateral beam structure 502 include a pair of axial or longitudinal bars 504 and 506 that form the first corner A, second pair of axial or longitudinal bars 508 and 512 that form the second corner B, a third pair of axial or longitudinal bars 516 and 518 that form the third corner C, and finally a fourth pair of bars 520 and 514 that form the last or the fourth corner D of the quadrilateral frame 502.

Coupling the corner "A" bars 504 and 506 to the corner "D" bars 520 and 514 are web or shear plates 510 and a first set of plates 211, which are sandwiched between the pairs of bars 520 and 514 at one end of the plates 510 and 211, and pairs of bars 504 and 506 at the other end of the plates 510 and 211. Coupling the corner "B" bars 512 and 508 to the corner "C" bars 518 and 516 are web or shear plates 552 and a second set of plates 211, which are also sandwiched between the pairs of bars 516 and 518 at one end of the plates 552, and pairs of bars 512 and 508 at the other end of the plates 552 and 211.

Coupling the corner "A" bars 506 and 504 to the corner "B" bars 512 and 508 are a set of web or shear plates 554, with a first end of the plates 554 coupled to bar 506, and a second end of the plate 554 coupled to the corner "B" bar 508. Coupling the corner "C" bars 518 and 516 to the corner "D" bars 520 and 514 are a set of web or shear plates 550, with a first end of the plates 550 coupled to bar 516, and a second end of the plate 550 coupled to the corner bar 520.

Figure 5D:
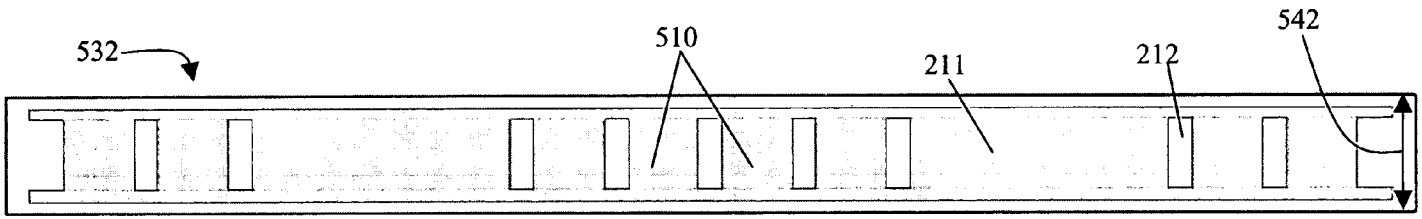
Figure 5D:
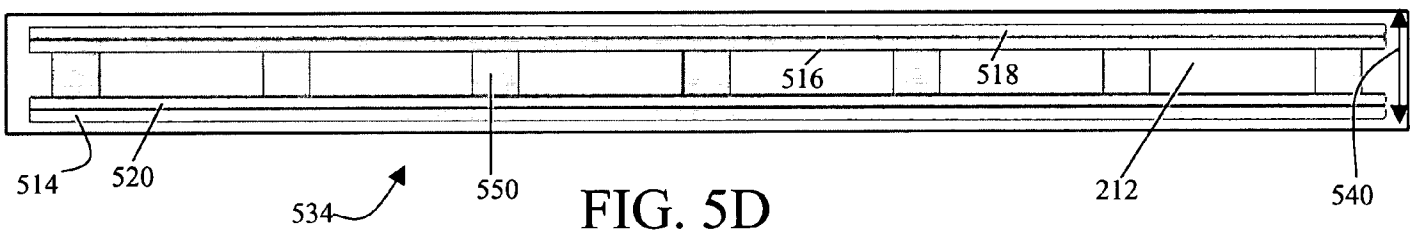

All plates are welded to the flanges (the one or more corner bars) in locations that can provide the optimum strength, weight, and bulk for the structure 502, with appropriate spacing 212 created between each individual plate for optimal curing of later injected material. Each set of plates is oriented normal to its adjacent set, and each plate within each set is coupled to its respective two flanges, aligned axially or longitudinally along a single plane passing through the axial length of both flanges. A completely fabricated structure 502 may be placed inside a mold to be encapsulated within body 204 using injection-molding techniques described above in relation to FIGS. 3A to 3H. FIG. 5D is an exemplary illustration of the beam 500 in the cross-sectional view along the axial length indicated by the reference 532, and the plan or top view 534 taken along the axial length of the beam.

FIGS. 6A to 6D are exemplary illustration of a second type of a four sided frame structure 602 in accordance with the present invention, with a substantially trapezoidal cross-section. Although not illustrated for brevity, it should be understood that like the previously illustrated I-beam frames 302 in all the FIGS. 3A to 3H, the four sided frame structure 602 may also be comprised of different flanges and web or shear plate constructions that vary in number, size, and shapes, similar to those illustrated in FIGS. 3A to 3H. In fact, each of the four sides of the quadrilateral structure 602 may be constructed by using any combinations and or permutations of the above-described structure 302. The four sided structure 602 has the added advantage in that it is a hybrid between a substantially square frame and a triangular square, providing both strength and high stability for the beam 600. However, the exterior body 204 dimensions remain the same, commensurate with industry standard practices where the beams are to be used.

Figure 6A:
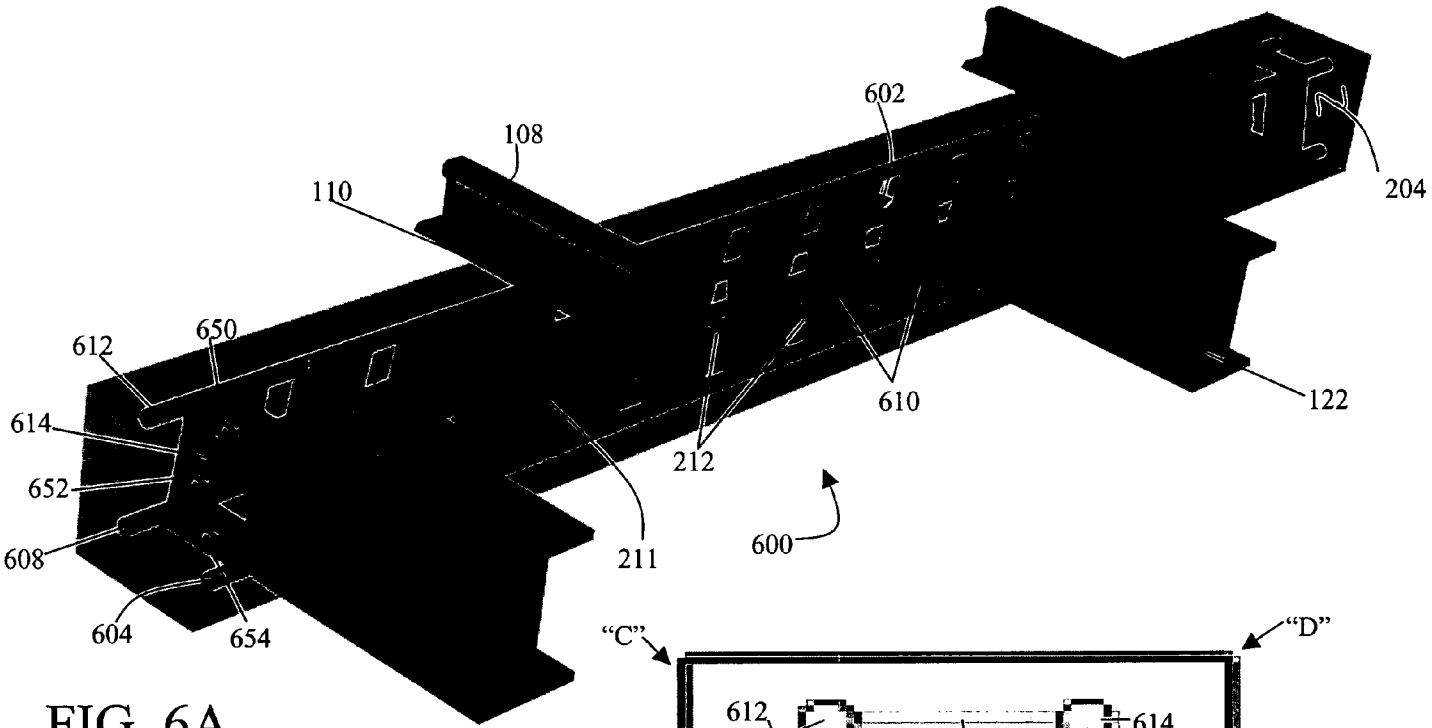
FIGS. 6A to 6D are exemplary illustration of another four sided reinforcement encapsulated inside a body, with FIGS. 6A and 6C illustrating the perspective view, FIG. 6B illustrating the cross-sectional view normal to the reinforcement, and FIG. 6D illustrating the cross-sectional view along the axis of the reinforcement and the top or plan view, all in accordance with the present invention.
Figure 6B:
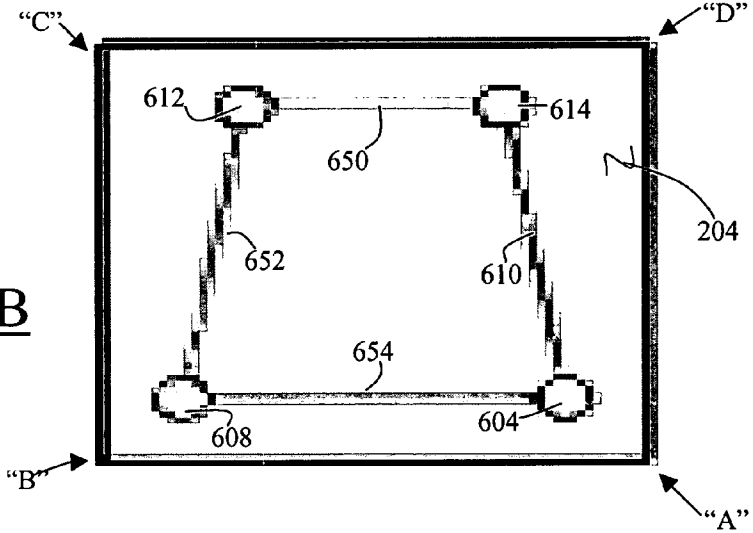
Figure 6C:
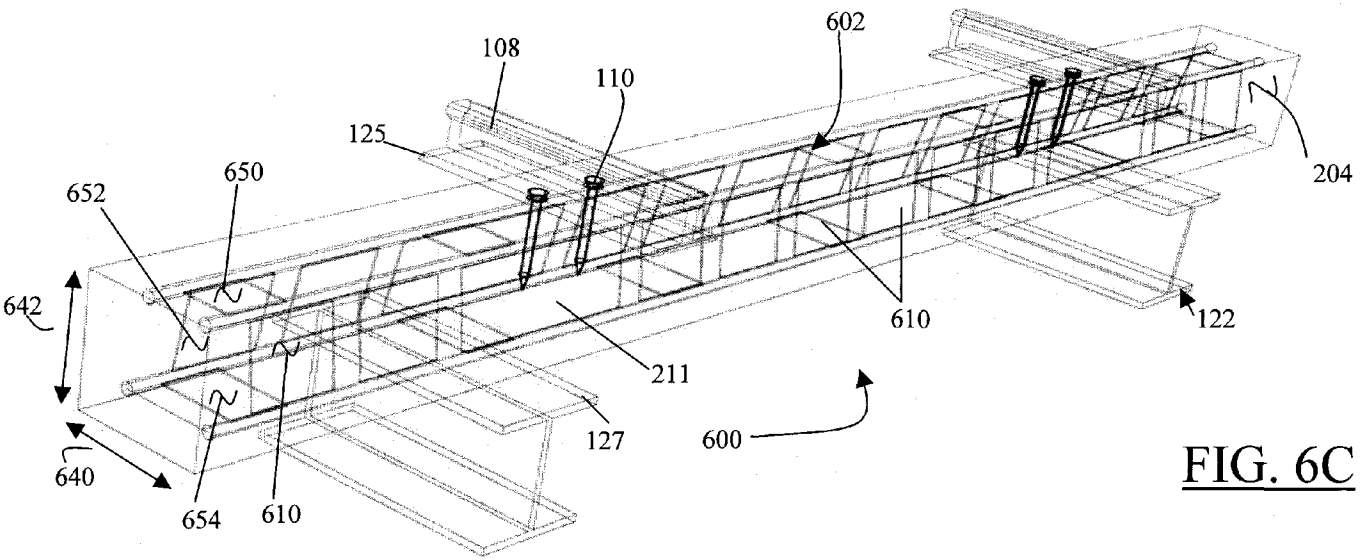

As FIGS. 6A to 6C illustrate, the tie 600 is comprised of a structure 602 that has a quadrilateral cross section, encapsulated in body 204. The quadrilateral structure 602 includes two upper and two lower flanges, each of which may be comprised of one or more axial or longitudinal bars. As best illustrated in FIG. 6B, the four corners A, B, C, and D of the quadrilateral beam structure 602 include an axial or longitudinal bar 604 that forms the first corner A, a second axial or longitudinal bar 608 that forms the second corner B, a third axial or longitudinal bar 612 that forms the third corner C, and finally a fourth bar 614 that forms the last or the fourth corner D of the quadrilateral frame 602.

Coupling the corner "A" bar 604 to the corner "D" bar 614 are a first set laterally inclined web or shear plates 610 and 211, and coupling the corner "B" bar 608 to the corner "C" bar 612 are a second set of laterally inclined web or shear plates 652 and 211. The respective first and second set of laterally inclined web or shear plates 610 and 652 (including the two sets of plates 211 within each respective set of plates 610 and 652) have opposing slopes, and each plate within its respective set is coupled so to allow a space 212 between the plates. The corner "A" bar 604 is further coupled to the corner "B" bar 608 by a third set of web or shear plates 654, and the corner "C" bar 612 is coupled to the corner "D" bar 614 by a fourth set of web or shear plates 650. The respective third and fourth set of web or shear plates 654 and 650 are oriented substantially parallel to one another, and each plate within its respective set is coupled so to allow a space 212 between the plates. All plates are welded to the flanges (the one or more corner bars) in locations that can provide the optimum strength, weight, and bulk for the structure 602, with appropriate spacing 212 created between each individual plate for optimal curing of later injected material.

Figure 6D:
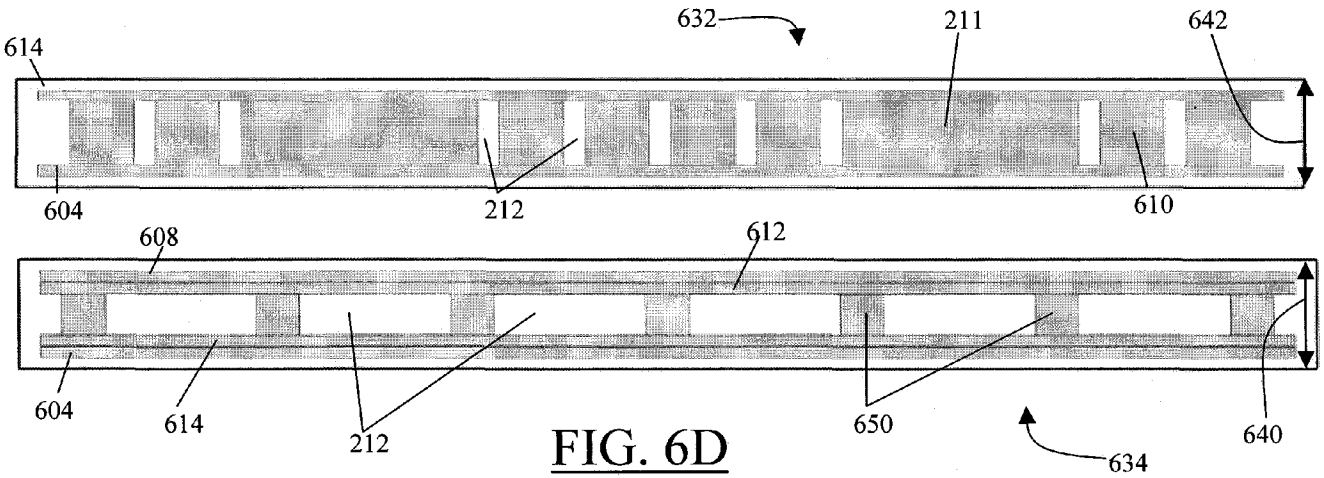

A completely fabricated structure 602 may be placed inside a mold to be encapsulated within body 204 using injection-molding techniques described above in relation to FIGS. 3A to 3H. FIG. 6D is an exemplary illustration of the beam 600 in the cross-sectional view along the axial length indicated by the reference 632, and the plan or top view 634 taken along the axial length of the beam.

Although the present invention has been described in considerable detail with reference to certain preferred versions thereof, other versions are possible. For example, although weldable steel or steel alloy is mentioned in the description as the preferred material used for making the frames, any material that can meet the strength requirement characteristics appropriate for use within a heavy load-bearing environment may be used. That is, any material having the appropriate characteristics to withstand the tensile, compression, shear, and torsion forces exerted by a heavy load may be used for the frames. Further, the parts (if more than one used to construct a frame, such as a web plate and two bars) of any frame that are welded, may be coupled by other mechanisms or technologies that can provide appropriate bonding strength. The material is limited to steel or steel alloy, but can be a structural plastic, and the bonding is not limited to welding. In addition, the parts of any frame need not be made from the same material. The application of the present invention should not be limited to the railroad industry, but can be applied to any field for which a need exists, including their use underneath roads or support bridges, for monorails, street cars and the like. The various reinforcement structures can be made of multiple components joined together such as by welding or an adhesive, or can be formed as a single component such as by molding.

Therefore, the spirit and scope of the appended claims should not be limited to the description of the preferred versions contained herein.

All features disclosed in the specification, including the claims, abstracts, and drawings, and all the steps in any method or process disclosed, may be combined in any combination, except combinations where at least some of such features and or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function, should not be interpreted as a "means" for "step" clause as specified in 35 U.S.C. §112.

What is claimed is:

1. A track for a vehicle comprising:

(a) at least one rail;

(b) a plurality of elongated ties supporting the rail; and (c) a plurality of spikes holding the rail to the ties, wherein at least a portion of the ties comprise (i) a body formed at least partially of polymeric material, and (ii) a reinforcement having a longitudinal axis totally encapsulated within the body, the reinforcement having opposed side walls parallel to the longitudinal axis and wherein there is at least one opening through the reinforcement from one side wall to the other side wall with polymeric material in the opening.

2. The track of claim 1 on a bridge.

3. The track of claim 1 comprising a pair of parallel rails.

4. The track of claim 1, wherein the body has a height, and the reinforcement has a height and the reinforcement is centrally encapsulated within the body such that the height of the reinforcement is substantially oriented parallel with the height of the body.

5. The track of claim 1, wherein the reinforcement comprises a top flange and a bottom flange.

6. The track of claim 5, wherein the top flange is comprised of at least one elongated top bar, and the bottom flange is comprised of at least one elongated bottom bar.

7. The track of claim 5, wherein the top flange is connected with the bottom flange by at least one shear plate, wherein the opening is through the shear plate.

8. The track of claim 6, wherein the top flange is comprised of at least two elongated top bars, and the bottom flange is comprised of at least two elongated bottom bars.

9. The track of claim 8, wherein at least one of the elongated top bars is connected with at least one of the elongated bottom bars by at least one shear plate, the shear plate having a top end and a bottom end, with the top end sandwiched between two elongated top bars, and the bottom end sandwiched between two elongated bottom bars.

10. The track of claim 1, wherein the reinforcement comprises:

a first top bar;

a second top bar;

a first bottom bar; and a second bottom bar;

wherein the first bottom bar is connected to the first top bar by a first set of shear plates;

the first bottom bar is connected to the second bottom bar by a second set of shear plates;

the second bottom bar is connected to the second top bar by a third set of shear plates; and the second top bar is connected to the first top bar by a fourth set of shear plates.

11. The track of claim 10, wherein at least some of the shear plates differ in length.

12. The track of claim 1, wherein the reinforcement comprises:

a first top flange having a first top bar and a second top bar;

a second top flange having a third top bar and a fourth top bar;

a first bottom flange having a first bottom bar and a second bottom bar;

a second bottom flange having a third bottom bar and a fourth bottom bar;

the first top bar and the second top bar are connected with the first bottom bar and the second bottom bar by a first set of shear plates having a first top end and a first bottom end, with the first top end sandwiched between the first top bar and the second top bar, and the first bottom end sandwiched between the first bottom bar and the second bottom bar;

the third top bar and the fourth top bar are connected with the third bottom bar and the fourth bottom bar by a second set of shear plates having a second top end and a second bottom end, with the second top end sandwiched between the third top bar and the fourth top bar, and the second bottom end sandwiched between the third bottom bar and the fourth bottom bar;

one of the first top bar and the second top bar is connected to one of the third top bar and the fourth top bar by a third set of shear plates; and one of the first bottom bar and the second bottom bar is connected to one of the third bottom bar and the fourth bottom bar by a fourth set of shear plates.

13. The track of claim 12, wherein the first set of shear plates is oriented substantially parallel to the second set of shear plates, and oriented substantially normal to the third set of shear plates and the fourth set of shear plates; and the third set of shear plates are oriented substantially parallel to the fourth set of shear plates, and oriented substantially normal to the first set of shear plates and the second set of shear plates.

14. The track of claim 1 comprising at least two openings, and wherein the reinforcement is rectangular in cross section and comprises at least two shear plates, each shear plate having opposed side walls parallel to the longitudinal axis, and each shear plate having at least one opening therethrough from one side wall to the other side wall.

15. The track of claim 1 wherein the tie is substantially rectangular prismatic body having a length of about 6 feet to about 14 feet, a width of from about 6 to about 16 inches, and a depth of from about 6 to about 16 inches.

16. A tie suitable for use on a railroad track comprising:

(a) a substantially rectangular prismatic body having a length of about 6 feet to about 14 feet, a width of from about 6 to about 16 inches, and a depth of from about 6 to about 16 inches, the body comprising a polymeric material; and (b) an elongated reinforcement structure substantially completely embedded in the prismatic body, the reinforcement structure having a length and a height and a longitudinal axis, the reinforcement structure including opposed side walls parallel to the longitudinal axis and wherein there is at least one opening through the reinforcement structure from one side wall to the other side wall with polymeric material in the opening.

17. The track of claim 16, wherein the body has a height, and the reinforcement has a height and the reinforcement is centrally encapsulated within the body such that the height of the reinforcement is substantially oriented parallel with the height of the body.

18. The track of claim 16, wherein the reinforcement comprises a top flange and a bottom flange connected by a shear plate, and wherein the opening is through the shear plate.

19. A track for a vehicle comprising:

(a) a pair of parallel rails;

(b) a plurality of elongated ties supporting the rails; and (c) a plurality of spikes holding the rail to the ties, wherein at least a portion of the ties comprise (i) a body formed at least partially of polymeric material, and (ii) a reinforcement totally encapsulated within the body, the reinforcement having a longitudinal axis and comprising a top flange, a bottom flange, at least one shear plate having opposed side walls parallel to the longitudinal axis, and an opening through the shear plate from one side wall to the other side wall with polymeric material in the opening.

20. The track of claim 19 on a bridge.

21. The track of claim 19, wherein the body has a height, and the reinforcement has a height and the reinforcement is centrally encapsulated within the body such that the height of the reinforcement is substantially oriented parallel with the height of the body.

22. The track of claim 19, wherein the top flange is comprised of at least two elongated top bars, and the bottom flange is comprised of at least two elongated bottom bars, wherein at least one of the elongated top bars is connected with at least one of the elongated bottom bars by the shear plate, the shear plate having a top end and a bottom end, with the top end sandwiched between two elongated top bars, and the bottom end sandwiched between two elongated bottom bars.

* * * * *